US011079165B2

(12) United States Patent
Dou et al.

(10) Patent No.: US 11,079,165 B2
(45) Date of Patent: Aug. 3, 2021

(54) REFRIGERATOR DOOR BODY

(71) Applicant: QINGDAO HAIER CO., LTD., Qingdao (CN)

(72) Inventors: Jinqiang Dou, Qingdao (CN); Shufei Ren, Qingdao (CN); Meng Wang, Qingdao (CN); Peng Wang, Qingdao (CN)

(73) Assignee: QINGDAO HAIER CO., LTD., Qingdao (CN)

( * ) Notice: Subject to any disclaimer, the term of this patent is extended or adjusted under 35 U.S.C. 154(b) by 0 days.

(21) Appl. No.: 16/753,338

(22) PCT Filed: Nov. 15, 2018

(86) PCT No.: PCT/CN2018/115568

§ 371 (c)(1),
(2) Date: Apr. 2, 2020

(87) PCT Pub. No.: WO2019/169892

PCT Pub. Date: Sep. 12, 2019

(65) Prior Publication Data

US 2020/0278147 A1 Sep. 3, 2020

(30) Foreign Application Priority Data

Mar. 9, 2018 (CN) ..... 201810194316.7

(51) Int. Cl.
*F25D 23/02* (2006.01)

(52) U.S. Cl.
CPC ..... *F25D 23/028* (2013.01); *F25D 2323/02* (2013.01)

(58) Field of Classification Search
CPC ..... F25D 23/02; F25D 23/028
USPC ..... 312/401, 405
See application file for complete search history.

(56) References Cited

U.S. PATENT DOCUMENTS 4,948,206 A * 8/1990 Fitzpatrick ..... A47F 3/043 312/296

FOREIGN PATENT DOCUMENTS

| | | | |
|---|---|---|---|
| CN | 201945126 | U | 8/2011 |
| CN | 104296468 | A | 1/2015 |
| CN | 205655575 | U | 10/2016 |
| CN | 106123456 | A | 11/2016 |
| CN | 106595205 | A | 4/2017 |
| EP | 2643646 | A2 | 5/2012 |
| EP | 2641040 | B1 | 4/2016 |
| JP | H8-61830 | A | 3/1996 |

(Continued)

*Primary Examiner* — James O Hansen
(74) *Attorney, Agent, or Firm* — Cheng-Ju Chiang

(57) ABSTRACT

A refrigerator door body comprises a door body frame and a glass panel attached to a front side of the door body frame. The door body frame comprises sheet metal frames located on two sides, end covers located on upper and lower sides, and connecting assemblies connecting the sheet metal frames to the end covers. The end cover is provided with a side flange and a covering edge located on an outer side of the side flange. After the end covers and the sheet metal frames are assembled, the side flange is fitted to an inner side of the sheet metal frame, and the covering edge is fitted to an outer side of the sheet metal frame, thereby ensuring that an end portion of the sheet metal frame is not easily eroded by moisture.

20 Claims, 9 Drawing Sheets

(56) References Cited

FOREIGN PATENT DOCUMENTS

| | | | |
|---|---|---|---|
| KR | 2003-0057087 | A | 7/2003 |
| WO | 2012/065850 | A2 | 5/2012 |

* cited by examiner

REFRIGERATOR DOOR BODY

The present application is a 35 U.S.C. § 371 National Phase conversion of International (PCT) Patent Application No. PCT/CN2018/115568, filed on Nov. 15, 2018, which claims priority to Chinese Patent Application No. 201810194316.7, filed to the Chinese Patent Office on Mar. 9, 2018 and titled "Refrigerator Door Body", the content of which is incorporated herein by reference in its entirety. The PCT International Patent Application was filed and published in Chinese.

TECHNICAL FIELD

The present invention relates to the field of refrigeration devices and in particular to a refrigerator door body capable of preventing a sheet metal frame from corrosion and rusting.

BACKGROUND

A conventional refrigerator glass door body is assembled by splicing aluminum alloy lateral side frames with upper and lower end covers, and by fixedly connecting the aluminum alloy lateral side frames with the upper and lower end covers with screws for subsequent foaming; however, since the costs of the glass panel and the aluminum alloy lateral side frames themselves are relatively high, the costs of the refrigerator glass door body are relatively high.

The conventional sheet metal frames are of lower costs, but end faces of the sheet metal frames are prone to corrosion and rusting due to moisture intrusion, which limits the use of the sheet metal frames.

In view of this, it is necessary to provide a new refrigerator door body to solve the above problems.

SUMMARY

An object of the present invention is to provide a refrigerator door body capable of preventing the sheet metal frames from erosion and rusting.

To achieve the above object, the present invention employs the following technical solutions:

A refrigerator door body, comprising a door body frame, the door body frame comprises sheet metal frames on left and right sides and end covers located on upper and lower sides, a portion of the end cover matching with the sheet metal frame is provided with a side flange protruding toward the sheet metal frame, and a shape of the side flange matches a shape of the sheet metal frame; the end cover is further provided with a covering edge which is spaced apart from the side flange and located on an outer side of the side flange, the covering edge and the side flange surround to form an insertion slot for insertion of the sheet metal frame; after the end covers and the sheet metal frames are assembled, the side flange is fitted to an inner side of the sheet metal frame, and the covering edge is fitted to an outer side of the sheet metal frame.

As a further improved technical solution of the present invention, the sheet metal frame comprises a side plate and end plates extending in the same direction from front and rear ends of the side plate in a direction perpendicular to a plane where the side plate is located, and wherein the covering edge comprises a side covering edge matching the side plate and a back covering edge matching the end plate located at a rear end of the side plate.

As a further improved technical solution of the present invention, a height of the covering edge is not less than 2 mm.

As a further improved technical solution of the present invention, an extension length of the end plate at the front end of the side plate is greater than the extension length of the end plate at the rear end of the side plate.

As a further improved technical solution of the present invention, the sheet metal frame further comprises a bent plate which is formed by bending inward from a side of the end plate away from the side plate, and a receiving portion for receiving the bent plate is recessed inward at a position of the side flange corresponding to the bent plate.

As a further improved technical solution of the present invention, a front flange is further disposed at the front side of the end cover, and wherein after the end cover is mounted on the sheet metal frame, the front flange is located in the same plane as the end plate at the front end.

As a further improved technical solution of the present invention, wherein the front flange is connected with the side flange.

As a further improved technical solution of the present invention, the refrigerator door body further comprises a glass panel attached to a front side of the door body frame, and the glass panel is attached to the front flange and located on the end plate on the front side.

As a further improved technical solution of the present invention, a covering edge extending forward projects from an edge portion of the end cover matching the edge of the glass panel; a length that the covering edge projects forward is not larger than the thickness of the glass panel As a further improved technical solution of the present invention, the end cover is integrally formed.

Advantageous effects of the present invention are as follows: according to the refrigerator door body in the present invention, on the one hand, the sheet metal frame is employed as the lateral side frame, reduces the costs of the refrigerator door body and improves the appearance effect of the refrigerator door body; on the other hand, the covering edge is provided. After the end cover is mounted on the sheet metal frame, the covering edge is fitted to the outer side of the sheet metal frame and ensures that the end portion of the sheet metal frame is not easily eroded by moisture, thereby preventing the end portion of the metal sheet lateral side frame from erosion and rusting.

DETAILED DESCRIPTION

Figure 1:
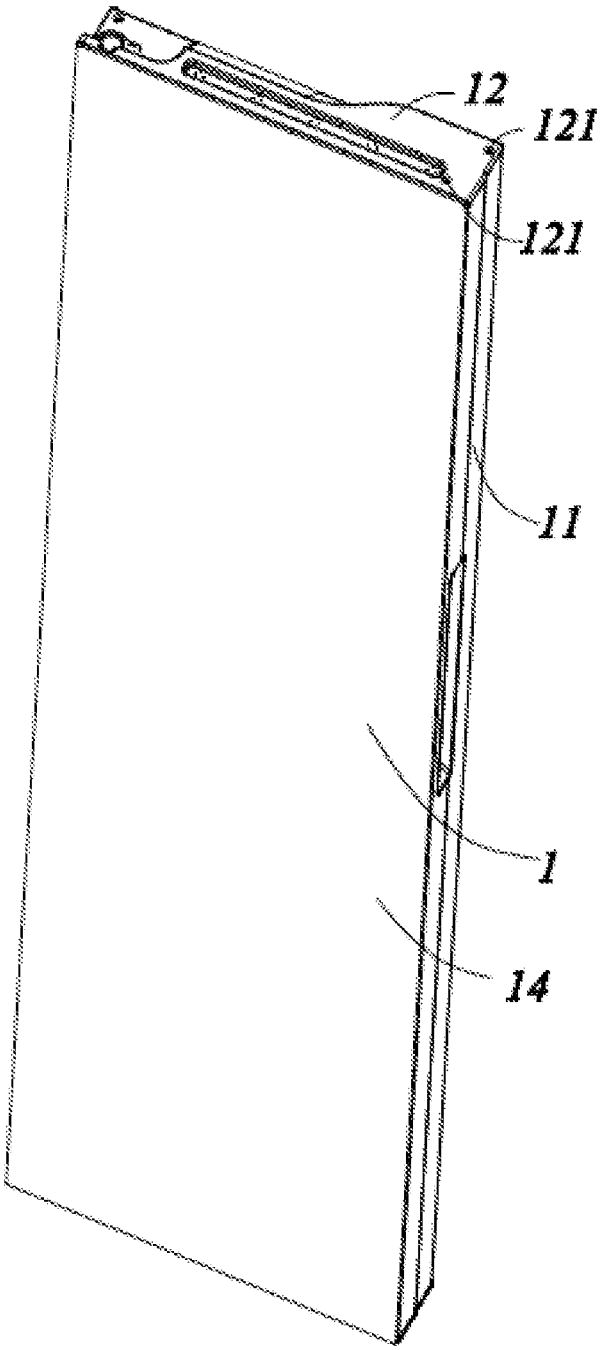
FIG. 1 is a schematic structural view of a refrigerator door body according to the present invention.
Figure 2:
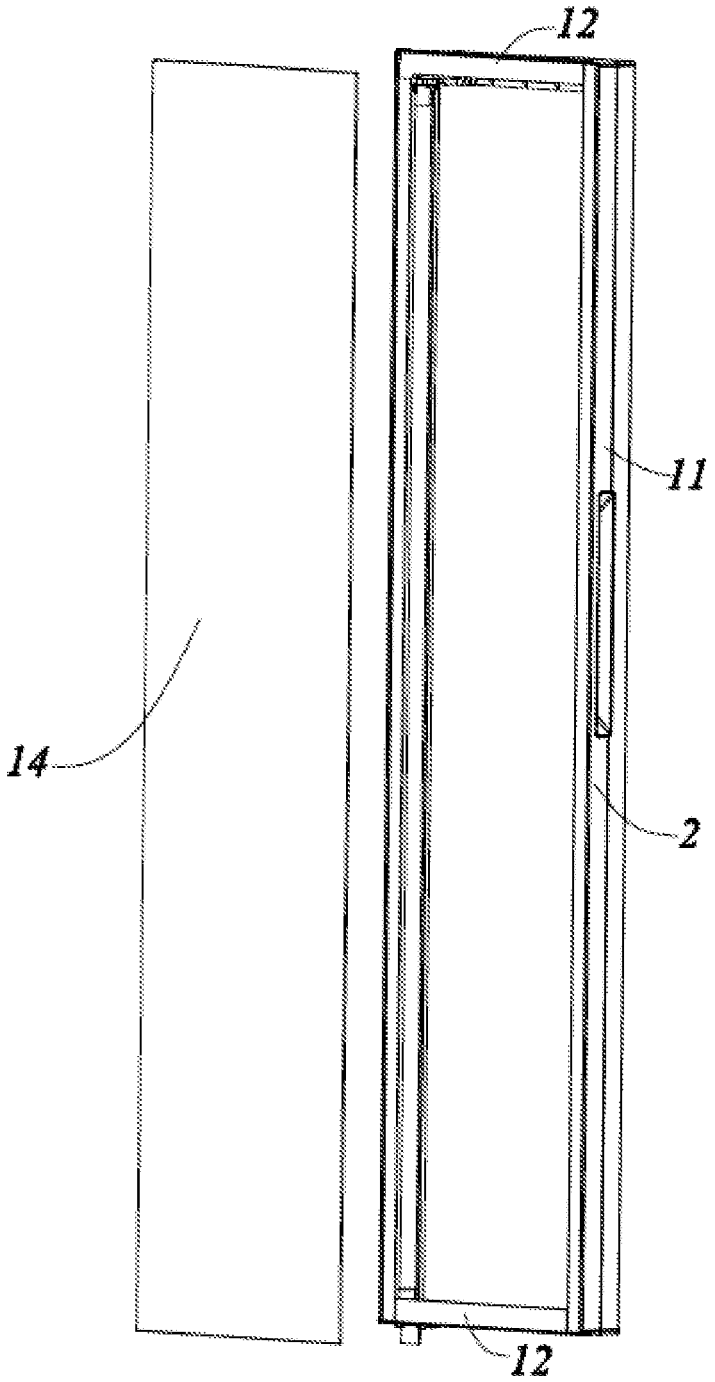
FIG. 2 is an exploded view of the refrigerator door body shown in FIG. 1.
Figure 3:
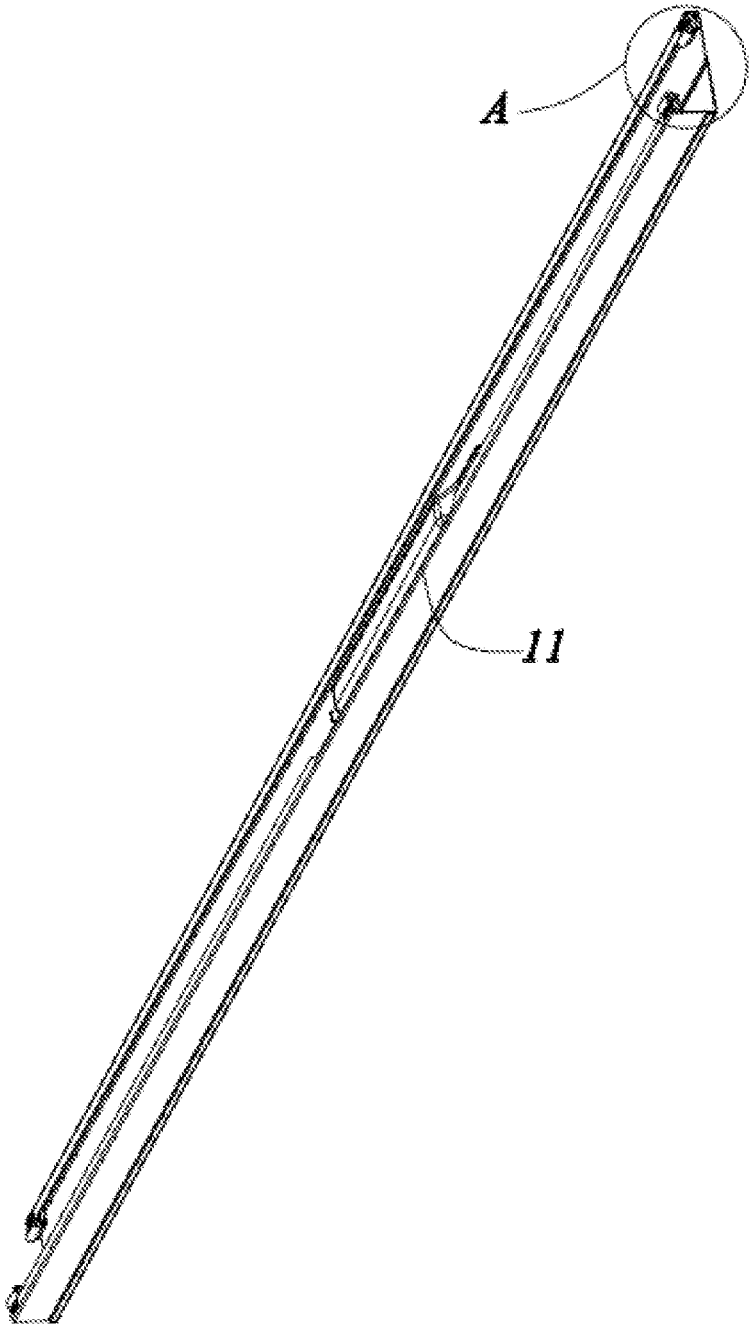
FIG. 3 is a schematic structural view of a sheet metal frame to which a connecting member is fixed according to the present invention.
Figure 4:
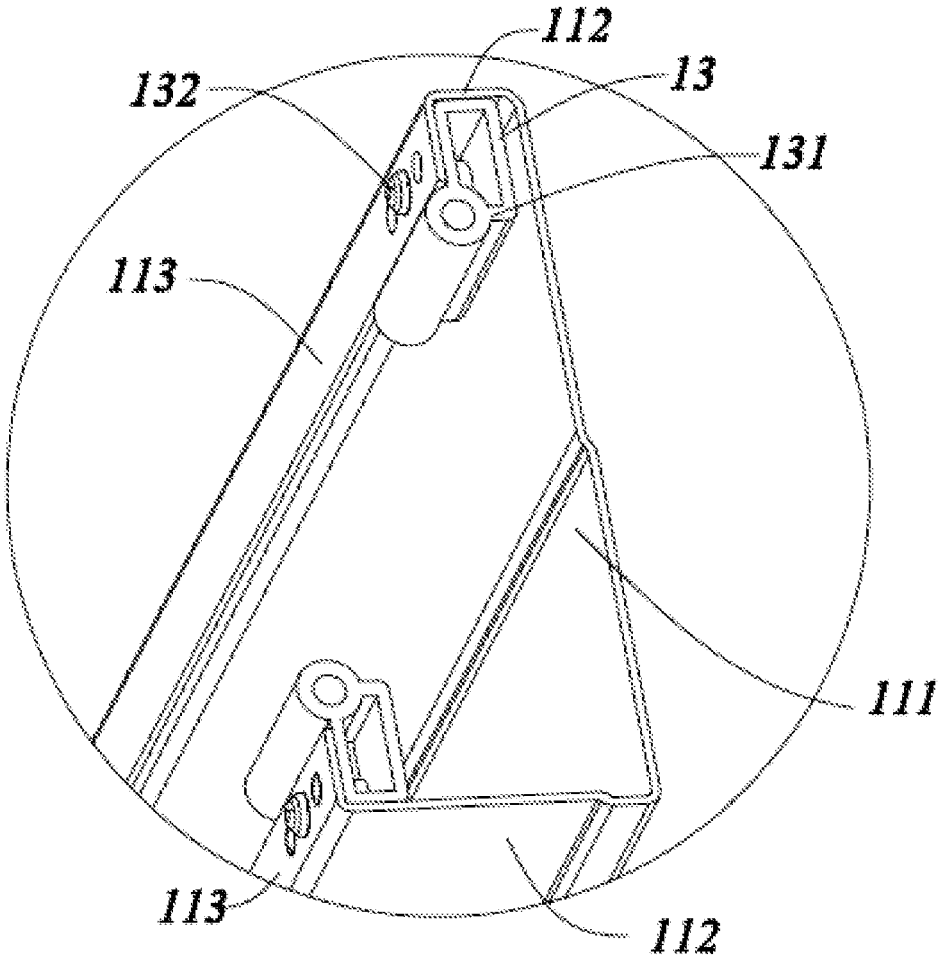
FIG. 4 is an enlarged structural schematic view of position A in FIG. 3.
Figure 5:
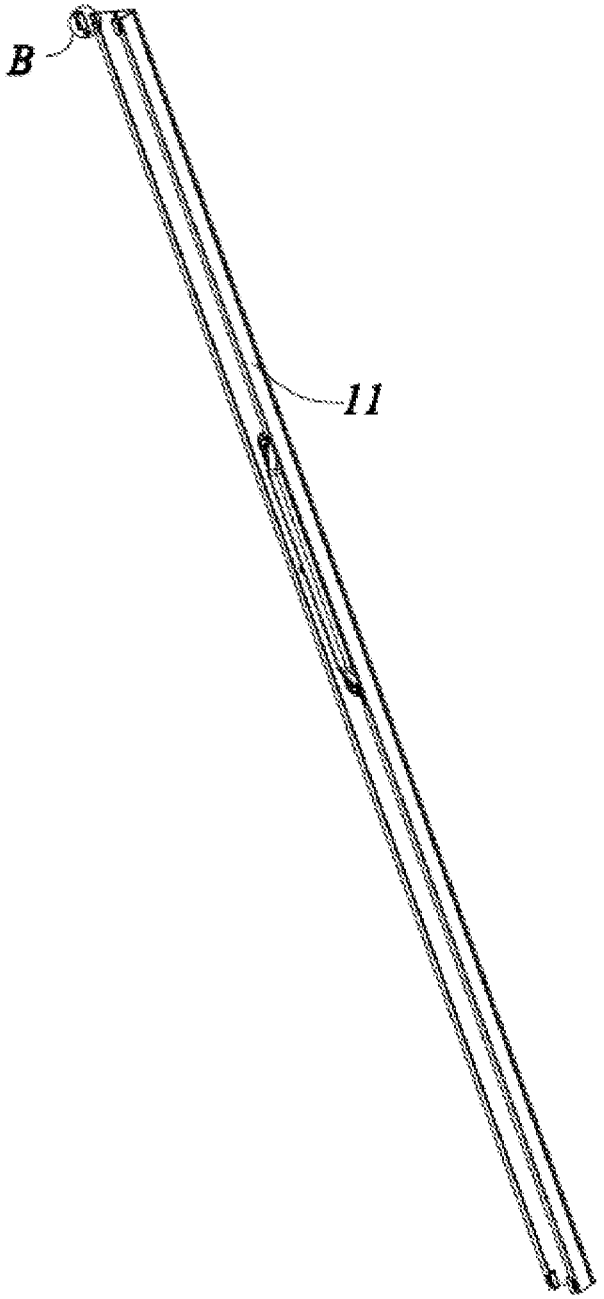
FIG. 5 is an exploded view of the sheet metal frame and the connecting member shown in FIG. 3.
Figure 6:
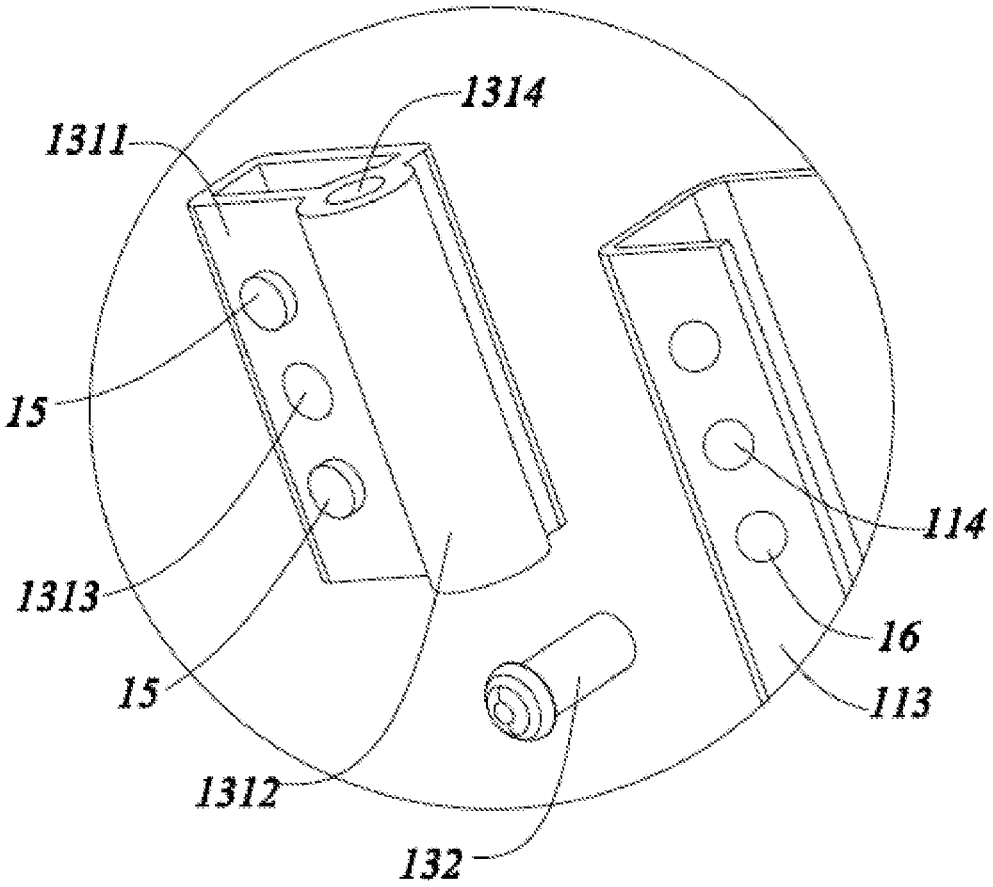
FIG. 6 is an enlarged structural schematic view of position B in FIG. 5.
Figure 7:
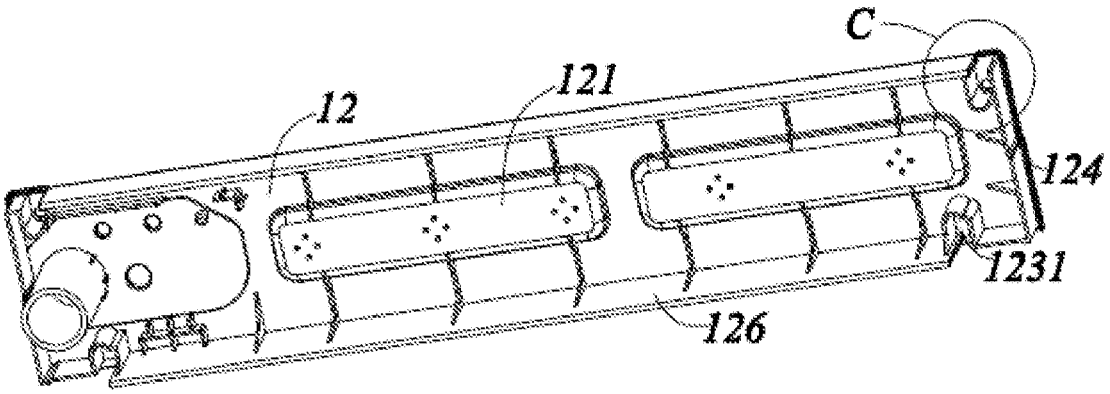
FIG. 7 is a schematic structural view of an end cover according to the present invention.
Figure 8:
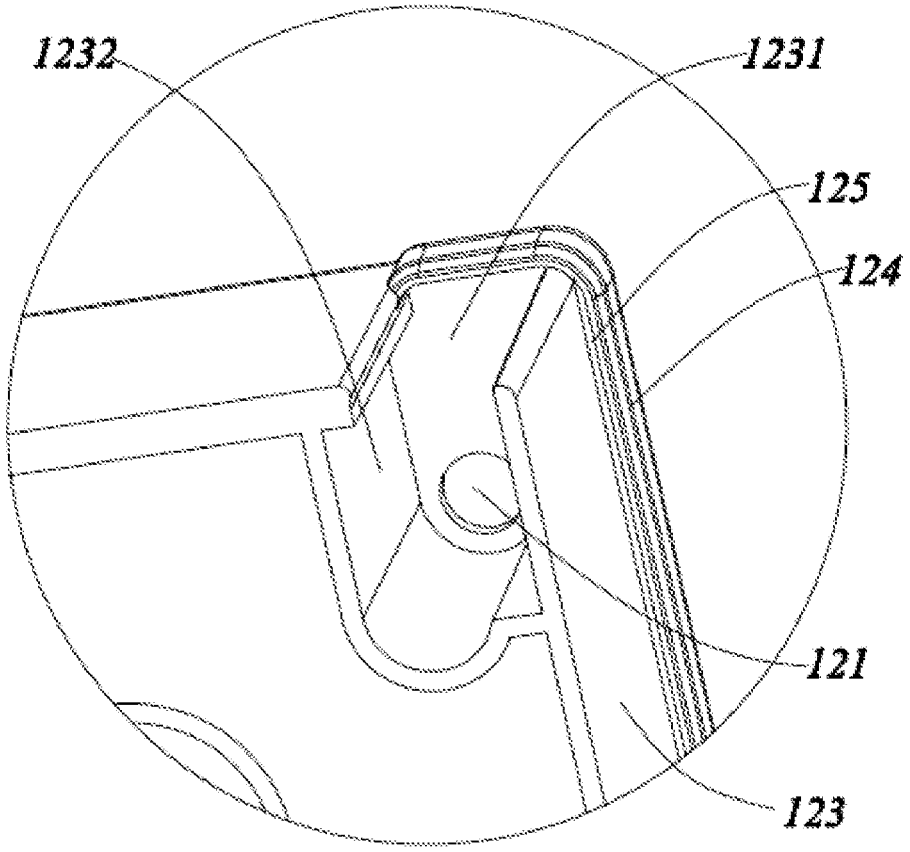
FIG. 8 is an enlarged structural schematic view of position C in FIG. 7.
Figure 9:
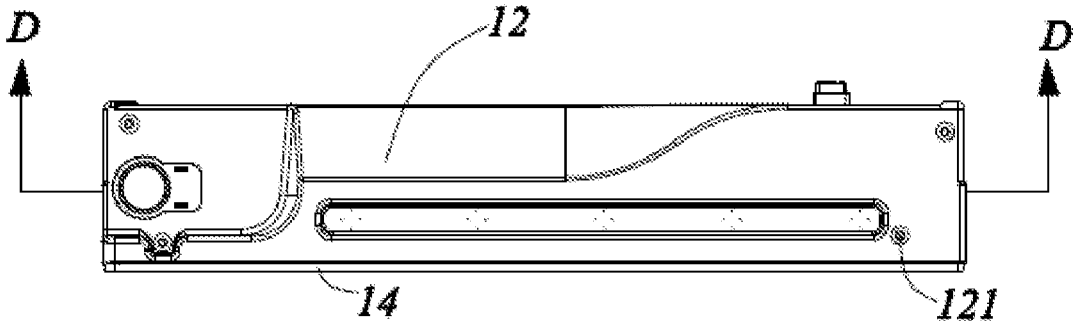
FIG. 9 is a schematic structural view of the refrigerator door body shown in FIG. 1 as viewed from another angle.
Figure 10:
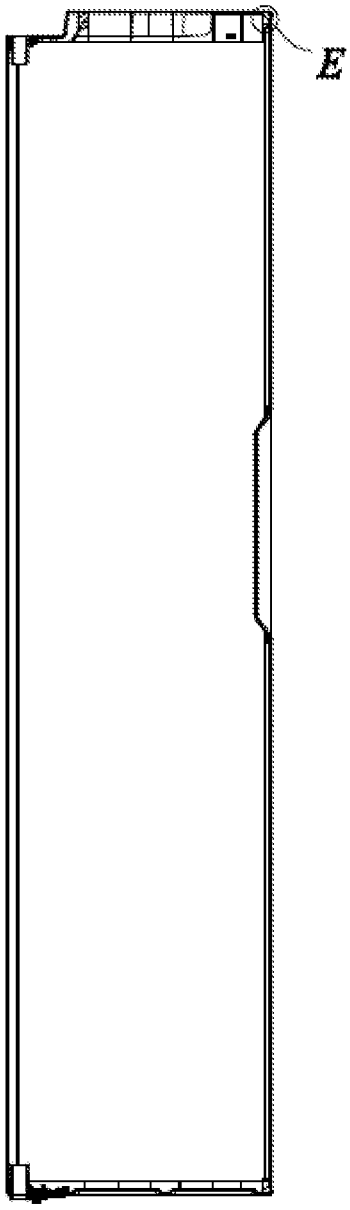
FIG. 10 is a cross-sectional view taken along the line D-D in FIG. 9.
Figure 11:
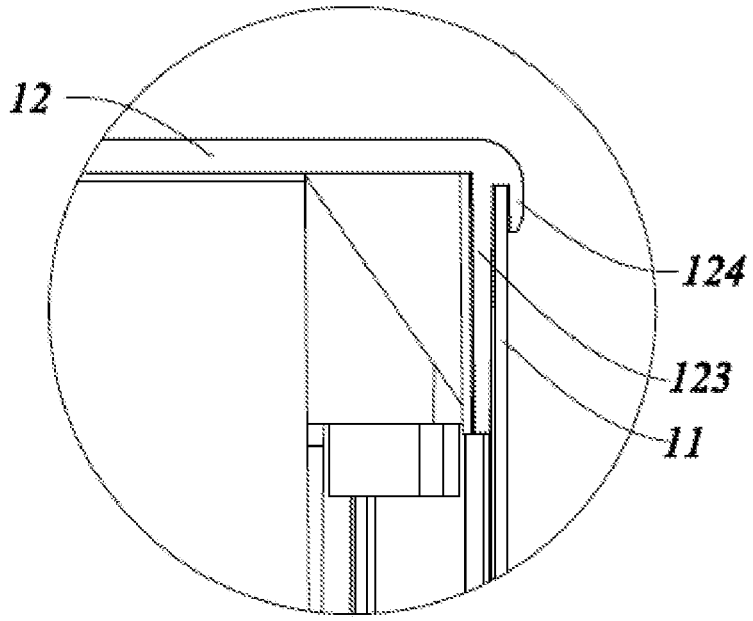
FIG. 11 is an enlarged structural schematic view of position E in FIG. 10.
Figure 12:
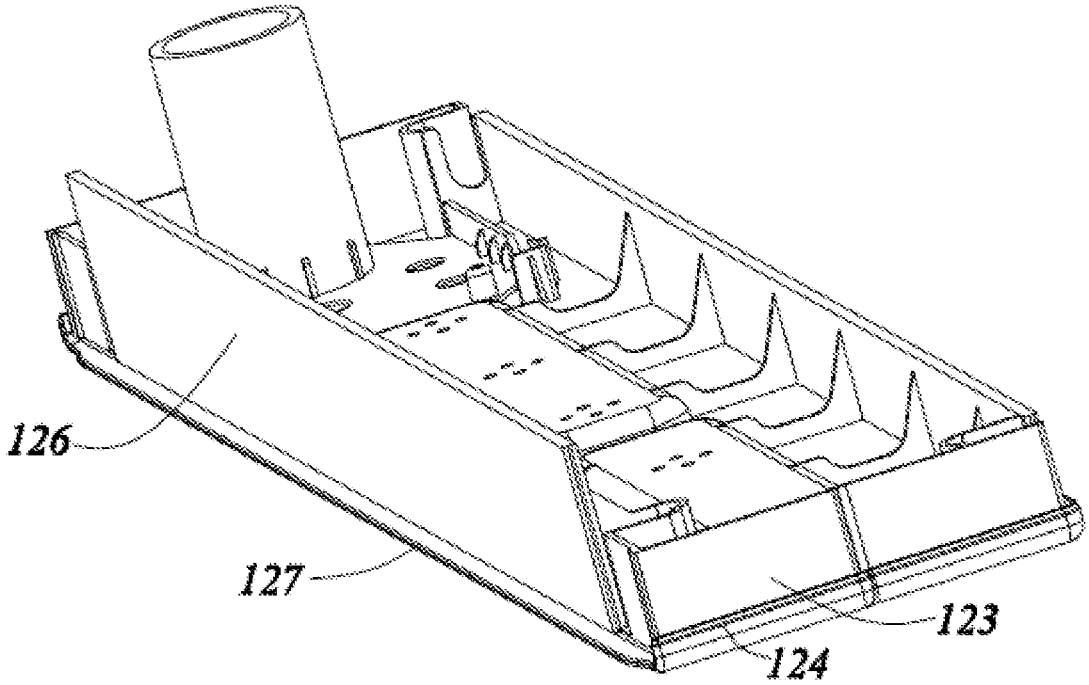
FIG. 12 is a schematic structural view of the end cover shown in FIG. 7 as viewed from another angle.

The present invention will be described in detail below with reference to embodiments shown in figures. FIG. 1 through FIG. 12 show preferred embodiments of the present invention.

Referring to FIG. 1 through FIG. 12, a refrigerator door body 1 according to the present invention includes a door body frame 2 and a glass panel 14 attached to a front side of the door body frame 2.

The refrigerator door body frame 2 includes sheet metal frames 11 on left and right sides, end covers 12 on upper and lower sides, and a connecting assembly 13 for connecting the sheet metal frames 11 with the end covers 12.

The sheet metal frames 11 are provided in the present invention to, on the one hand, replace conventional aluminum alloy lateral side frames, reduce production costs of the refrigerator door body 1, present a beautiful appearance and enhance grades and levels of products, and on the other hand, provide a higher strength and reduce occurrence of scratches during use of the refrigerator door body 1.

The sheet metal frame 11 includes a side plate 111 and end plates 112 extending in the same direction from front and rear ends of the side plate 111 in a direction perpendicular to a plane where the side plate 111 is located. An extension length of the end plate 112 located at the front end of the side plate 111 is greater than the extension length of the end plate 112 located at the rear end of the side plate 111. After the glass panel 14 is attached to the door body frame 2, the glass panel 14 is attached to the end plate 112 located at the front end of the side plate 111, thereby increasing the contact area between the glass panel 14 and the sheet metal frame 11, to strengthen the connection strength of the glass panel 14 and the sheet metal frame 11.

Furthermore, the sheet metal frame 11 further includes a bent plate 113 which is formed by bending inward from a side of the end plate 112 away from the side plate 111, and which is used to fix the connecting assembly 13. On the one hand, the bent plate 113 does not affect the appearance of the sheet metal frame 11 and the connection between the glass panel 14 and the sheet metal frame 11; on the other hand, one end of the sheet metal frame 11 is fixed to the end cover 12 via two connecting assemblies 13, one of the two connecting assemblies 13 is disposed adjacent to the front side of the sheet metal frame 11, and the other is disposed adjacent to the rear side of the sheet metal frame 11, thereby reinforcing the fixing strength of the end cover 12 and the sheet metal frame 11.

The connecting assembly 13 includes a connecting member 131, a first fixing member 132 for fixing the connecting member 131 to the sheet metal frame 11, and a second fixing member (not shown) for fixing the end cover 12 to the connecting member 131.

The connecting member 131 includes a first connecting portion 1311 for connecting with the sheet metal frame 11 and a second connecting portion 1312 for connecting with the end cover 12. The first connecting portion 1311 and the second connecting portion 1312 are arranged side by side in a horizontal direction, to achieve simultaneous connection of the connecting member 131 with the end cover 12 and the sheet metal frame 11.

Meanwhile, the connecting member 131 is an injection-molded member, which facilitate processing and can reduce the costs.

Specifically, the first fixing member 132 is a rivet, the sheet metal frame 11 is provided with a first through hole 114 matching with the rivet, and the first connecting portion 1311 is provided with a second through hole 1313 communicated with the first through hole 114.

The first through hole 114 is provided on the bent plate 113. When the connecting member 131 is installed, the first through hole 114 is communicated with the second through hole 1313 first, and then the rivet is inserted through and riveted to the first through hole 114 and the second through hole 1313.

Furthermore, one of the first connecting portion 1311 and the bent plate 113 is provided with at least one protruding post 15, and the other is provided with at least one receiving hole 16 that receives and corresponds to the at least one protruding post 15. On the one hand, before the connecting member 131 is mounted on the sheet metal frame 11, the protruding post 15 is first received in the receiving hole 16 and can be positioned in advance so that the first through hole 114 is communicated with the second through hole 1313 to facilitate the fixation of the rivet; on the other hand, after the connecting member 131 is fixed to the sheet metal frame 11 through the rivet, the protruding post 15 can position the connecting member 131 to prevent the connecting member 131 from turning about the rivet, thereby enhancing the stability of the connecting member 131 connected to the sheet metal frame 11.

The connecting member 131 is fixed to ends of each of the upper end and lower end of the sheet metal frame 11, thereby facilitating fixation and connection of the two end covers 12 at the upper side and lower side with the connecting members 131.

Specifically, the second fixing member is a screw; the second connecting portion 1312 is provided with a threaded hole 1314 that mates with the screw, and the end cover 12 is provided with a perforation 121 for the screw to pass therethrough.

The threaded hole 1314 extends vertically, so that the user can fix the end cover 12 with the sheet metal frame 11 through the screw.

When the end cover 12 is fixed, the connecting member 131 is first fixed to the sheet metal frame 11, then the end cover 12 is assembled to the sheet metal frame 11 in a way that the perforation 121 is communicated with the threaded hole 1314, and finally the screw is inserted through the perforation 121 and threadedly connected in the threaded hole 1314, thereby achieving the fixation of the end cover 12 with the sheet metal frame 11. Furthermore, the fixation between the end cover 12 and the sheet metal frame 11 is firm and stable.

After the sheet metal frame 11 is fixedly connected with the end cover 12 are fixedly connected to each other, the sheet metal frame 11 and the end cover 12 enclose to form the door body frame 2.

A portion of the end cover 12 matching with the sheet metal frame 11 is provided with a side flange 123 protruding toward the sheet metal frame 11. The shape of the side flange 123 matches the shape of the sheet metal frame 11. After the end cover 12 is assembled with the sheet metal frame 11, the side flange 123 is fitted to the inner side of the sheet metal frame 11, which on the one hand, can enable pre-positioning so that the perforation 121 communicates with the threaded hole 1314 to facilitate the fitting of the screw, and on the other hand, can enhance the sealing performance of the connection between the sheet metal frame 11 and the end cover 12, prevent the foaming material from leaking from the connection of the sheet metal frame 11 and the end cover 12, and enhance the connecting strength between the end cover 12 and the sheet metal frame 11 under the action of a pressing force of the solid foaming material after the foaming material changes from a liquid state to a solid state.

Specifically, a receiving cavity 1231 for receiving the connecting member 131 is recessed inward at a position of the side flange 123 at a position corresponding to the connecting member 131, and meanwhile a receiving portion 1232 for receiving the bent plate 113 is recessed inward at a position of the side flange 123 corresponding to the bent plate 113. The receiving portion 1232 is communicated with the receiving cavity 1231. After the end cover 12 is assembled with the sheet metal frame 11, the bent plate 113 is received in the receiving portion 1232 while the connecting member 131 is received in the receiving cavity 231 to further enhance the pre-positioning accuracy and the connecting strength between the sheet metal frame 11 and the end cover 12.

Furthermore, the end cover 12 is further provided with a covering edge 124 which is spaced apart from the side flange 123 and located on an outer side of the side flange 123. The covering edge 124 and the side flange 123 surround to form an insertion slot 125 for insertion of the sheet metal frame 11. After the end cover 12 and the sheet metal frames 11 is assembled, an end portion of the sheet metal frame 11 is located in the insertion slot 125, and meanwhile the side flange 123 is fitted to the inner side of the sheet metal frame 11, and the covering edge 124 is fitted to the outer side of the sheet metal frame 11 to ensure that the end portion of the sheet metal frame 11 is not easily eroded by moisture, thereby preventing the end portion of the metal sheet lateral side frame 11 from erosion and rusting.

Furthermore, the height in the vertical direction of the covering edge 124 is not less than 2 mm, so that the end portion of the sheet metal frame 11 can be stably fixed in the insertion slot 125.

Specifically, in the present embodiment, the height of the covering edge 124 is 5 mm, which on the one hand, enables the end portion of the sheet metal frame 11 to be stably fixed in the insertion slot 125, and on the other hand, facilitates the overall appearance of the refrigerator door body 1.

The covering edge 124 includes a side covering edge matching the side plate 111 and a back covering edge matching the end plate 112 located at a rear end of the side plate 111. On the one hand, this avoids affecting the mounting of the glass panel 4; on the other hand, after the glass panel is attached to the door body frame 2, it covers a portion of the sheet metal frame 11 away from the cabinet, and meanwhile the portion of the sheet metal frame 11 away from the cabinet is not subject to the erosion from the moisture in the cabinet, so the covering edge 124 may not be disposed at the portion of the end cover 12 matching the end plate 112 located at the front end of the side plate 111.

Furthermore, a front flange 126 matching the glass panel 14 is further disposed at the front side of the end cover 12. After the end cover 12 is mounted on the sheet metal frame 11, the front flange 126 is located in the same plane as the end plate 112 at the front end. After the glass panel 14 is attached to the door body frame 2, the glass panel 14 is attached to the front flange 126 and located on the end plate 112 at the front end, so that the glass panel 14 can be tightly attached to the front side of the door body frame 2, and the connecting strength of the glass panel 14 and the door body frame 2 can be reinforced.

Furthermore, the front flange 126 is connected with the side flange 123, and the end cover 12 is integrally formed and can be easily processed.

Furthermore, a covering edge 127 extending forward projects from an edge portion of the end cover 12 matching the edge of the glass panel 14. The length that the covering edge 127 projects forward is not larger than the thickness of the glass panel 14. On the one hand, the covering edge 127 can pre-position the glass panel 14 when the glass panel 14 is attached; on the other hand, after the glass panel 14 is attached to the front side of the door body frame 2, the covering edge 127 covers at least part of the edge of the glass panel 14 to prevent the occurrence of a gap which affects the appearance of the refrigerator door body 1.

To conclude, according to the refrigerator door body 1 in the present invention, on the one hand, the sheet metal frame 11 is employed as the lateral side frame, reduces the costs of the refrigerator door body 1 and improves the appearance effect of the refrigerator door body 1; on the other hand, the covering edge 124 is provided. After the end cover is mounted on the sheet metal frame 11, the covering edge 124 is fitted to the outer side of the sheet metal frame 11 and ensures that the end portion of the sheet metal frame 11 is not easily eroded by moisture, thereby preventing the end portion of the metal sheet lateral side frame 11 from erosion and rusting.

It should be understood that although the description is described according to the embodiments, not every embodiment only includes one independent technical solution, that such a description manner is only for the sake of clarity, that those skilled in the art should take the description as an integral part, and that the technical solutions in the embodiments may be suitably combined to form other embodiments understandable by those skilled in the art.

The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. A refrigerator door body, comprising a door body frame, wherein the door body frame comprises sheet metal frames on left and right sides and end covers located on upper and lower sides, a portion of the end cover matching with the sheet metal frame is provided with a side flange protruding toward the sheet metal frame, and a shape of the side flange matches a shape of the sheet metal frame; the end cover is further provided with a covering edge which is spaced apart from the side flange and located on an outer side of the side flange, the covering edge and the side flange surround to form an insertion slot for insertion of the sheet metal frame; after the end covers and the sheet metal frames are assembled, the side flange is fitted to an inner side of the sheet metal frame, and the covering edge is fitted to an outer side of the sheet metal frame;

wherein the sheet metal frame comprises a side plate, first and second end plates extending respectively in the same direction from front and rear ends of the side plate in a direction perpendicular to a plane where the side plate is located, and a bent plate is formed by bending inward from a side of each of the first and second end plates away from the side plate, the bent plate of the first end plate extends toward the second end plate while the bent plate of the second end plate extends toward the first end plate.

2. The refrigerator door body according to claim 1, wherein the covering edge comprises a side covering edge matching the side plate and a back covering edge matching the end plate located at a rear end of the side plate.

3. The refrigerator door body according to claim 2, wherein an extension length of the end plate at the front end of the side plate is greater than the extension length of the end plate at the rear end of the side plate.

4. The refrigerator door body according to claim 2, wherein a receiving portion for receiving a selective bent plate from the bent plates of the first and second end plates is recessed inward at a position of the side flange corresponding to the selective bent plate.

5. The refrigerator door body according to claim 2, wherein a front flange is further disposed at the front side of the end cover, and wherein after the end cover is mounted on the sheet metal frame, the front flange is located in the same plane as the end plate at the front end.

6. The refrigerator door body according to claim 5, wherein the front flange is connected with the side flange.

7. The refrigerator door body according to claim 5, wherein the refrigerator door body further comprises a glass panel attached to a front side of the door body frame, and the glass panel is attached to the front flange and located on the end plate on the front side.

8. The refrigerator door body according to claim 7, wherein a covering edge extending forward projects from an edge portion of the end cover matching the edge of the glass panel; a length that the covering edge projects forward is not larger than the thickness of the glass panel.

9. The refrigerator door body according to claim 1, wherein a height of the covering edge is not less than 2 mm.

10. The refrigerator door body according to claim 1, wherein the end cover is integrally formed.

11. A refrigerator door body, comprising a door body frame, wherein the door body frame comprises sheet metal frames on left and right sides and end covers located on upper and lower sides, a portion of the end cover matching with the sheet metal frame is provided with a side flange protruding toward the sheet metal frame, and a shape of the side flange matches a shape of the sheet metal frame; the end cover is further provided with a covering edge which is spaced apart from the side flange and located on an outer side of the side flange, the covering edge and the side flange surround to form an insertion slot for insertion of the sheet metal frame; after the end covers and the sheet metal frames are assembled, the side flange is fitted to an inner side of the sheet metal frame, and the covering edge is fitted to an outer side of the sheet metal frame;

the sheet metal frame comprises a side plate and end plates extending respectively in the same direction from front and rear ends of the side plate in a direction perpendicular to a plane where the side plate is located, and a bent plate is formed by bending inward from a side of each of the end plates away from the side plate;

wherein a refrigerator door body further comprises a connecting assembly made independently, the connecting assembly includes a connecting member which comprises a first connecting portion for connecting with one of the bent plates of the end plates and a second connecting portion for connecting with the end cover, a first fixing member for fixing the first connecting portion to the one of the bent plates along a first direction perpendicular to the one of the bent plates, and a second fixing member for fixing the end cover to the second connecting portion along a second direction perpendicular to the first direction, the first connecting portion and the second connecting portion are arranged side by side along a third direction perpendicular to both of the first and second directions.

12. The refrigerator door body according to claim 11, wherein the end plates comprise a first end plate and a second end plate, the bent plate of the first end plate extends toward the second end plate while the bent plate of the second end plate extends toward the first end plate.

13. The refrigerator door body according to claim 11, wherein the first fixing member is a rivet, the bent plate is provided with a first through hole matching with the rivet, and the first connecting portion is provided with a second through hole communicated with the first through hole.

14. The refrigerator door body according to claim 11, wherein one of the first connecting portion and the bent plate is provided with at least one protruding post, and the other is provided with at least one receiving hole.

15. The refrigerator door body according to claim 11, wherein the second fixing member is a screw; the second connecting portion is provided with a threaded hole that mates with the screw, and the end cover is provided with a perforation for the screw to pass therethrough, the threaded hole extends vertically.

16. The refrigerator door body according to claim 11, wherein the covering edge comprises a side covering edge matching the side plate and a back covering edge matching the end plate located at a rear end of the side plate.

17. The refrigerator door body according to claim 11, wherein a height of the covering edge is not less than 2 mm.

18. The refrigerator door body according to claim 11, wherein a receiving portion for receiving a selective bent plate from the bent plates of the end plates is recessed inward at a position of the side flange corresponding to the selective bent plate.

19. The refrigerator door body according to claim 11, wherein a front flange is further disposed at the front side of the end cover, and wherein after the end cover is mounted on the sheet metal frame, the front flange is located in the same plane as the end plate at the front end.

20. The refrigerator door body according to claim 19, wherein the refrigerator door body further comprises a glass panel attached to a front side of the door body frame, and the glass panel is attached to the front flange and located on the end plate on the front side.

* * * * *